United States Patent [19]

Glover et al.

[11] 4,077,872

[45] Mar. 7, 1978

[54] MAGNETIC SEPARATOR AND METHOD FOR SEPARATING MAGNETIC PARTICLES FROM NON-MAGNETIC PARTICLES

[75] Inventors: Douglas Glover; Marvin J. Minter, both of Ann Arbor, Mich.

[73] Assignee: Federal-Mogul Corporation, Detroit, Mich.

[21] Appl. No.: 762,909

[22] Filed: Jan. 27, 1977

[51] Int. Cl.[2] ..... B03C 1/08

[52] U.S. Cl. ..... 209/214; 209/222

[58] Field of Search ..... 209/213, 214, 222, 223 R, 209/225–227, 219; 324/14, 34 R, 41

[56] References Cited

U.S. PATENT DOCUMENTS

| | | | |
|---|---|---|---|
| 1,462,111 | 7/1923 | Jobke | 209/222 |
| 1,527,071 | 2/1925 | Peck | 209/222 X |
| 1,686,917 | 10/1928 | McAdams | 209/222 |
| 3,015,394 | 1/1962 | Woods | 209/222 |
| 3,083,830 | 4/1963 | Broderick | 209/226 X |

*Primary Examiner*—Frank W. Lutter
*Assistant Examiner*—Ralph J. Hill
*Attorney, Agent, or Firm*—Robert F. Hess

[57] ABSTRACT

A quantitative magnetic separator and method for isolating non-magnetic particles from contaminated magnetic powder mixtures to determine the relative purity of magnetic powder. The separation is effected by restraining the powder mixture below a relatively moving magnetic field which agitates the magnetic particles and allows the non-magnetic particles to disengage and free-fall by gravity into a receiver for subsequent measurement of the degree of contamination.

17 Claims, 5 Drawing Figures

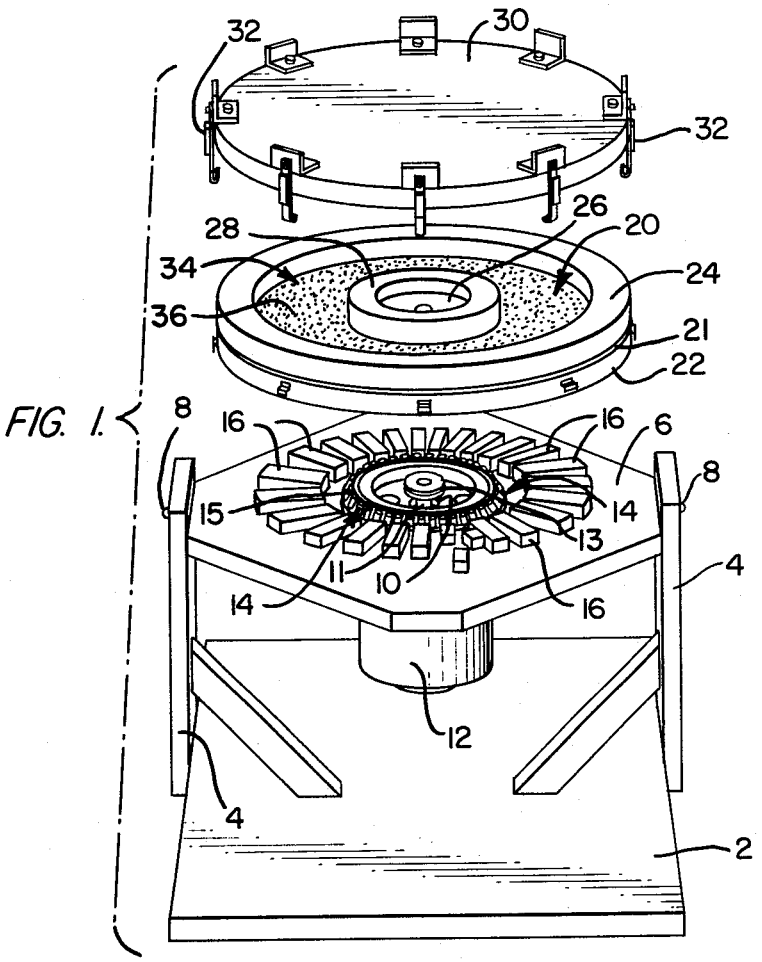
FIG. 1.
FIG. 2.
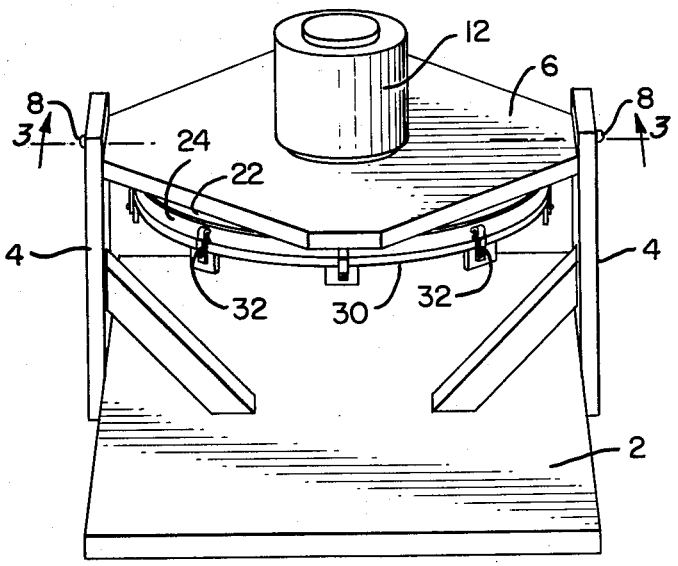

MAGNETIC SEPARATOR AND METHOD FOR SEPARATING MAGNETIC PARTICLES FROM NON-MAGNETIC PARTICLES

BACKGROUND OF THE INVENTION

The present invention is particularly applicable but not necessarily limited to the inspection of samples of ferrous powdered metals of the type employed in the art of powder metallurgy to determine their degree of contamination by non-magnetic particles. It is contemplated that the apparatus and method can also be satisfactorily employed for effecting a physical separation of particulated mixture of magnetic and non-magnetic particles on a commercial production scale.

Ferrous-base metal powders, such as steel powders, for example, are in widespread commercial use for the fabrication of a wide variety of parts and components employing powder metallurgical techniques. It is conventional practice to subject such ferrous powders to inspection to assure that they are of the requisite purity to produde finished metal parts of the desired physical properties. Analytical techniques heretofore employed in ascertaining the purity of such ferrous alloy powders have been exceedingly costly, complex, tedious, time consuming and normally require highly-skilled technicians to obtain accurate and reproductible results.

The magnetic separator and method comprising the present invention utilized in laboratory quality control determinations overcomes many of the problems and disadvantages associated with prior art practices in providing a simple and durable instrument and technique that enable accurate determinations of the degree of contamination of magnetic ferrous powders with non-magnetic materials which can be quickly performed by laboratory personnel or ordinary skill without requiring special analytical training.

SUMMARY OF THE INVENTION

The benefits and advantages of the present invention are achieved in accordance with its apparatus aspects by a magnetic separator which comprises a framework on which a plurality of magnetic means, such as permanent bar magnets, for example, are mounted and are arranged in a circular pattern. The individual magnets are preferably oriented in a radial direction and in an alternating north-south polarity. A sample of the contaminated ferrous or magnetic powder mixture to be analyzed is adapted to be placed in a tray provided with a planar base composed of a non-magnetic material and which is formed with an annular sample cavity of a size and configuration generally conforming to the size and configuration of the circular pattern of the magnetic means. A premeasured quantity of the powder mixture is adapted to be placed in the annular cavity, and non-magnetic cover means are removably mounted on the tray for closing or sealing the annular cavity.

The tray is removably mounted on the framework with the base of the tray disposed in spaced clearance relationship from the magnetic means and with the annular cavity containing the powder sample disposed in aligned relationship relative to the circular pattern. Drive means are provided for relatively rotating the tray and the magnetic means with the assembly in an operating position in which the tray is disposed in an inverted position, with the base thereof positioned beneath the magnetic means so as to impart agitation and a tumbling action to the magnetic powder particles, causing the non-magnetic particles to separate and free-fall through the action of gravity to the base of the cavity as defined by the non-magnetic cover plate. The framework is preferably provided with a support plate on which the magnetic means and drive means are mounted, which is pivotally mounted on the framework so as to enable an inversion thereof from an upright position corresponding to a load position for receiving the tray containing the powder sample, and the operating position in which the tray, magnetic means and support plate are pivoted as a unit through 180° about a substantially horizontal axis.

It will be apparent from the foregoing arrangement that the relative rotation of the powder mixture and the alternating magnetic fields causes magnetic agglomerates of the powder to be agitated by a tumbling action, enabling the non-magnetic particles to become disengaged and to fall downwardly due to the force of gravity while the magnetic particles are retained against the base of the tray by the strong magnetic field. After a prescribed time period, relative rotation between the magnetic means and powder sample is halted and while still in an inverted operating position, the cover is removed from the tray and the non-magnetic particles contained thereon are isolated and a determination of the quantity is made. The period of operation of the magnetic separator to produce accurate and reproducible results has been empirically established at about 15 minutes, with time periods in excess of that not producing any material difference in the magnitude of isolation of non-magnetic contaminants.

In accordance with its method aspects, the present invention provides a quick, simple and accurate technique for exposing and extracting non-magnetic particles from magnetic particles and separately recovering the isolated powders.

Additional benefits and advantages of the present invention will become apparent upon a reading of the description of the preferred embodiments taken in conjunction with the accompanying drawings.

BRIEF DESCRIPTION OF THE DRAWINGS

FIG. 1 is a partially exploded view in perspective of the magnetic separator in the "load" position;

FIG. 2 is a perspective view of the invention in the "operate" position;

DESCRIPTION OF THE PREFERRED EMBODIMENTS

Figure 3:
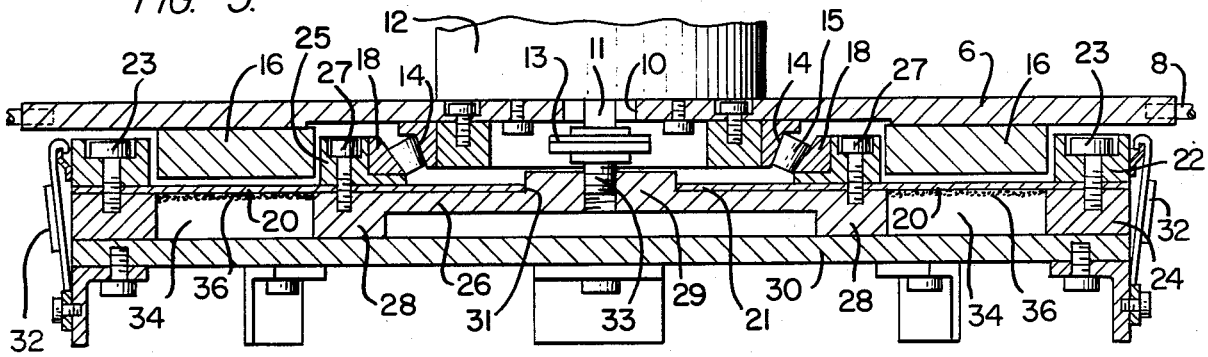
FIG. 3 is a fragmentary cross sectional view of the magnetic separator shown in FIG. 2, as taken along the line 3—3 thereof.

The partially exploded perspective in FIG. 1 shows a base plate 2, to which is attached two braced upright members 4. The upright members 4 pivotally support a magnet support plate 6 by means of pins 8 affixed to the diagonally opposite edges of the plate. The magnet support plate 6 contains a centrally located hole 10 through which extends a drive shaft 11 of a drive motor 12, which is attached to the lower surface of the magnet support plate 6. On the upper surface of the magnet support plate 6 and concentrically located with the drive shaft hole 10 is attached an inner race 14 of a tapered roller bearing with associated non-separable conical rollers and cage 15. Also attached to the upper surface of the magnetic support plage 6 are a plurality of bar magnets 16 which are positioned radially outward from the inner race 14 and symmetrically concentric with the axis of rotation of the drive shaft 11. The inner ends of the magnets 16 are spaced radially outwardly from the inner race 14 to allow insertion, without interference, of the outer bearing race 18, as may be best seen in FIG. 3.

A sample tray, indicated at 20, which is of a generally circular configuration, is comprised of a thin base sheet 21 composed of a non-magnetic material, such as, for example, a non-magnetic stainless steel sheet stock of 0.037 inch in thickness. The periphery of the base 21 is rigidified by means of rings 22 and 24 which are composed of a non-magnetic material and are preferably comprised of an aluminum alloy. The rings 22 and 24 are securely fastened to each other by a plurality of screws 23 (see FIG. 3) having the threaded shank portions thereof extending through apertures in the base sheet 21 and threadably engaged in threaded apertures of the ring 24.

An annular collar 25 (see FIG. 3) is mounted on the surface of the base 21 and is secured to an annular drive plate 26 disposed on the opposite side of the base by a means of a plurality of screws 27 (see FIG. 3). The collar 25 is formed with an inner annular notch in which the outer bearing race 18 is affixed in supported relationship and concentric to the center of the sample tray. The drive plate 26 includes an annular boss 29 (see FIG. 3) which is piloted through a central aperture 31 (see FIG. 3) formed in the base 21 of the sample tray. The annular boss 29 is provided with a bore in which a shaft 33 (see FIG. 3) is affixed to the upper end of which, as viewed in FIG. 3, one-half of a separable coupling 13 is secured for drivingly engaging the sample tray with the drive shaft 11 of the drive motor. The separable coupling 13 is of the type well known in the art incorporating interfitting engaging dogs in the opposed faces for transferring torque from the drive member to the driven member thereof.

The drive plate 26 is formed with an annular shoulder 28 extending around the periphery thereof which acts as a spacer and defines the inner side of an annular sample cavity 34. The ring 24 and shoulder 28 act as stops against which a cover plate 30 of a non-magnetic material, such as aluminum, is clamped by spring clamps 32. The size of the cavity 34 is dictated by many factors which for best results must be determined empirically. These factors include the size of the magnets used; the speed of relative rotation between magnets and sample, the thickness of the air gap and the thickness of the stainless steel sample tray. A prototype model of the invention uses a cavity with an outside diameter of 18-$\frac{3}{8}$ inches, an inside diameter of 9-$\frac{1}{4}$ inches and a depth of $\frac{5}{8}$ inches for receiving a 500 gram sample of a powder mixture. A drive motor is employed to obtain a relative speed of rotation of 9 rpm. The magnetic strength of 24 magnets through a 0.020 inch air gap and a 0.037 inch thick stainless steel sample tray is approximately 100:1; i.e., 50 kilograms to pull away a 500 gram sample.

The apparatus is illustrated in FIG. 1 in the load position in which the drive motor 12 is disposed on the underside of the magnet support plate 6 and with the magnets 16 and conical rollers and cage 15 facing upwardly. In a typical operation, the sample tray with the cover 30 removed therefrom is placed such that the outer race member 18 thereof is disposed in aligned rolling bearing contact with the conical rollers 15 and in which the annular sample cavity 34 is disposed in aligned adjacent relationship with the circular pattern of the magnets 16. A premeasured quantity of a powder mixture 36 is poured into the cavity 34 and spread out in a substantially uniform layer. The cover plate 30 is thereafter placed over the tray and clamped against the outer surfaces of the annular shoulder 28 and supporting ring 24 and retained in clamped position by means of the spring clamps 32.

The magnet support plate, along with the closed sample tray, is thereafter pivoted as a unit on pins 8 through an angularity of about 180° from the load position shown in FIG. 1 to the inverted operating position shown in FIG. 2.

The magnetic attraction between the magnets 16 and the powered sample in the annular cavity produces a magnetic coupling force sufficient to firmly retain the sample tray in aligned mounted position in close proximity to the magnet support plate by the magnetic coupling force created. In this position, as best seen in FIG. 3, the outer bearing race 18 is held in contact with the rollers of the conical roller and cage assembly 15 by the magnetic attraction of the magnetic particles of the powder mixture to the magnets 16 by the lines of flux extending through the non-magnetic base sheet 21 of the sample tray. In the specific prototype arrangement employed, the magnetic coupling force or attraction is about 50 kilograms. As will be noted in FIG. 3, the sample tray is retained in appropriate aligned position relative to the magnets 16 and in spaced clearance relationship therefrom, enabling rotation as guided by the conical roller and cage assembly through the driving connection provided by the separable coupling 13.

Figure 4:
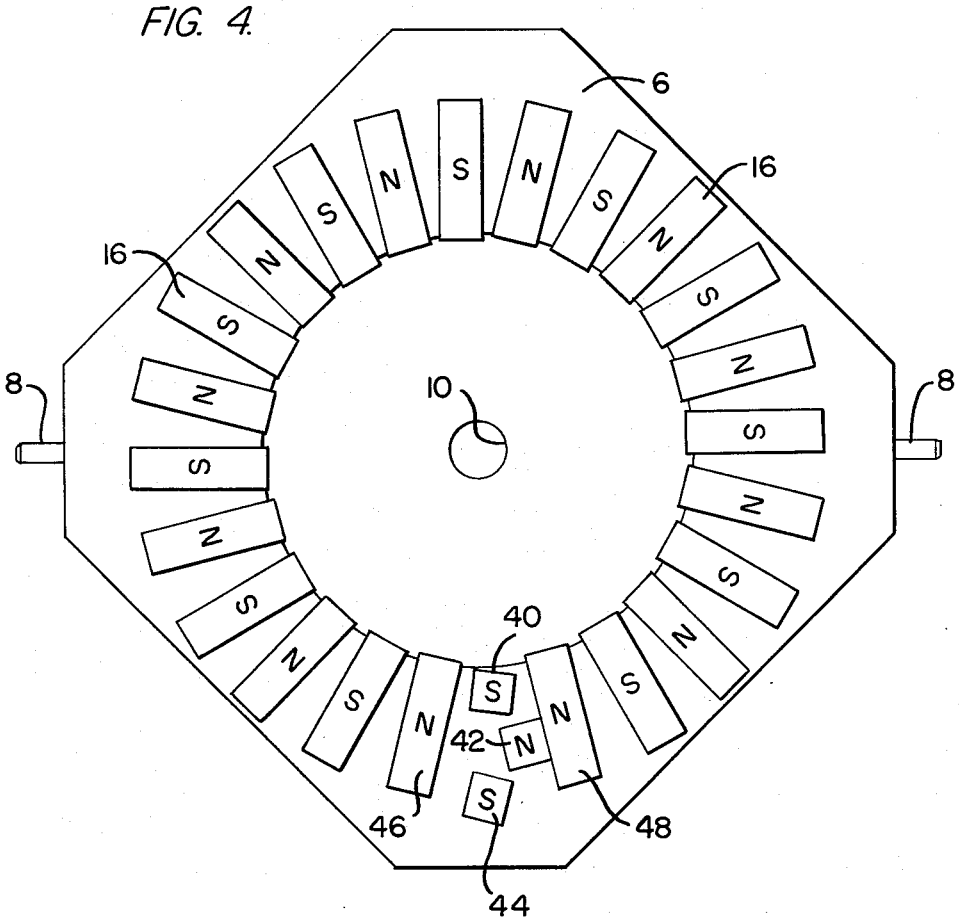
FIG. 4 is a plan view of the magnet arrangement on the magnet support plate.
Figure 5:
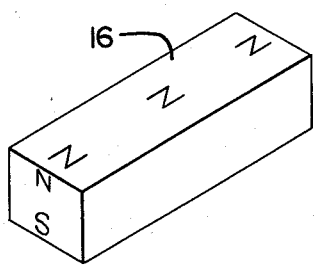
FIG. 5 is a perspective view of a magnet indicating the polar orientation across the minor axis thereof.

FIG. 4 shows in detail a plan view of the arrangement of the magnets 16 on the magnet support plate 6. The basic magnets 16 are rectangular prisms which have been magnetized across their minor axis or shortest dimension to impart opposite polarity to their opposed major surfaces as shown in perspective in FIG. 5.

Best results are obtained when an even number of magnets 16 are used. The individual magnets 16 are positioned on the magnet support plate 6 in a circle which is concentric with the axis of rotation of the tray and are arranged such that their major axis extends radially outward from the centrally located drive shaft hole 10. It will be noted that a major edge of each magnet, rather than the center line thereof, is positioned along the radius of the circle of magnets. Thus, each magnet 16 is positioned at a slight angular displacement from a true radial alignment. This angular displacement prevents the magnetic particles 16 from migrating toward the inner region of the annular cavity 34, providing a more uniform distribution of the powder mixture across the surface of the base sheet 21. For angular displacement as shown in FIG. 4, the relative rotation of the magnetic particles must be in a clockwise direction.

The angular displacement of each magnet causes agglomerates of the magnetic particles to undergo a twisting motion during their tumbling action as the agglomerate traverses the magnetic lines of force on moving from one radial edge of a bar magnet across the magnet to the opposite radial edge thereof. This twisting movement in combination with the tumbling action causes relative movement of the particles within each agglomerate, which causes a liberation of non-magnetic particles entrapped therein, which thereafter free-fall through the action of gravity and collect on the inner surface of the cover of the inverted sample tray.

The polarity of each magnet, as shown in the arrangement illustrated in FIG. 4, alternates from north to south polarity on traveling along the circular pattern. At one location, however, one of the magnets is subdivided into three essentially equal parts, indicated at 40, 42 and 44. The parts 40 and 44 are mounted so as to retain a polarity opposite from that of the adjacent magnets 46 and 48, while the third part 42 is inverted to have the same polarity as the adjacent magnets 46 and 48.

The use of the segmented sections 40, 42 and 44 produces a discontinuity in the repetitive magnetic pattern as traversed by the magnetic particles in response to relative rotation of the tray and magnet support plate.

It has been discovered that without the discontinuity in the magnetic pattern provided by the segments 40, 42, 44, the magnetic particles tend to build ridges. When this occurs, the concentration of agglomerates or strings of the magnetic particles becomes so great and the agglomerates become so long that they extend across the sample cavity and brush against the cover plate at which the non-magnetic particles are collecting. Such brushing action of the magnetized strings or agglomerates tends to pick up non-magnetic particles and remix them with the magnetic particles.

The discontinuity of the magnetic pattern as shown at 40, 42, 44, 46 and 48 has the effect of spreading out the agglomerates of magnetic particles once every revolution of the sample tray 20. This prevents the build up of such agglomerates along circumferential lines within the magnetic field and prevents their attaining excessive lengths, whereby a pick-up and remixing of non-magnetic particles by the magnetic particles is avoided.

The action of the magnetic particles is very unique as they progress around the alternating magnetic field. In the operation of the prototype, the magnetic particles form agglomerates or strings about a quarter of an inch long that "flipflop" or tumble end for end as they progress from the influence of the magnetic field of one magnet of one polarity to the next magnetic field of the opposite polarity. The magnetic particles within each agglomerate are continually changing position with relation to the other particles, providing a continuing agitation. An interchange of magnetic particles from one agglomerate to an adjacent agglomerate also occurs so that new surfaces are continually being exposed to the outside. A rubbing action also helps disengage the non-magnetic particles from the magnetic particles so that separation by gravity is more effectively accomplished.

The "tumbling" action is particularly interesting in the region between the magnets. In these regions, the elongated agglomerates of magnet particles lie flat against the stainless steel sample tray 20. While traversing the magnets 16, however, the agglomerates move from a horizontal position to an angularly inclined position, assuming a vertical position at the middle of the magnet. On further movement, the agglomerates move toward an inclined position in the other direction as the other edge of the magnet is approached. As each magnet is approached, however, the horizontal magnetic agglomerates gather kinetic energy so that the transition from a horizontal position to an inclination of about 30° is almost instantaneous even though the angular velocity of the particles around the circle of magnets is only about 45 feet per minute. This abrupt change in orientation of the magnetic agglomerates results in a snapping or whipping action that is violent enough to disengage some of the magnetic particles, as well as some of the non-magnetic particles from the strings. It is important, therefore, that the sample cavity 34 be controlled at a depth as dictated by the spacers 24 and 28, so that room for the "flip-flop" action is provided without brushing the ejected non-magnetic particles and still allow ejected magnetic particles to be reattracted to the main body of magnetic agglomerates as they progress around the magnetic fields.

A 500 gram sample of steel powder placed in the prototype separator as hereinbefore described requires about 15 minutes rotating at 9 RPM to separate all the non-magnetic contamination. At the completion of the operating cycle, the clamps 32 of the cover plate 30 are released. The cover plate 30 is lowered together with the non-magnetic contaminants which have collected on the polished inside surface thereof. The contaminants can then be removed from the cover plate with an anti-static brush, into a suitable container for subsequent weighing.

In accordance with the method aspects of the present invention, the separation of non-magnetic particles from magnetic particles in powder mixtures is performed in accordance with the description perviously set forth, whereby elongated agglomerates of the magnetic particles containing entrapped non-magnetic particles therein are subjected to internal agitation by means of a tumbling and twisting action imparted thereto as a result of the relative rotation of the powder mixture and the alternating pattern of magnetic fields. The relative speed of movement of the magnetic fields and the powder mixture is dictated by that speed at which an adequate tumbling action and internal agitation of such magnetic agglomerates is attained up to speeds at which the agglomerates disintegrate and the particles, both magnetic and non-magnetic, ricochet randomly between the walls of the cavity. In the specific prototype model employed, a relative rotation of sample tray and magnetic means of about 9 revolutions per minute provides a relative mean speed of about 44.5 feet per minute. The specific speed, however, will very depending on the width of the alternating magnetic north-south pattern with greater spacings providing for corresponding increased speeds and with shorter magnetic field spacings required corresponding reductions in speed.

While it will be apparent that the invention herein described is well calculated to achieve the benefits and advantages set forth above, it will be appreciated that the invention is susceptible to modification, variation and change without departing from the spirit thereof.

What is claimed is:

1. A magnetic separator for separating non-magnetic particles from magnetic particles comprising a framework, a plurality of magnetic means on said framework disposed in a circular pattern and arranged in alternating north-south polarity, a tray having a base comprised of a non-magnetic material and formed with an annular cavity of a size and configuration generally conforming to that of said circular pattern and adapted to be partially filled with a powder mixture, cover means removably mounted on said tray in spaced relationship from said base for closing said cavity, mounting means for mounting said tray with said base and said cavity in aligned adjacent relationship to said magnetic means, means for moving said tray to and from a load position in which said base of said tray is positioned below said cover means and an operating position in which said tray is inverted and disposed below said magnetic means, and drive means for relatively rotating said tray and said magnetic means when in said operating position to impart a tumbling action to the particles of the powder mixture in response to the traversing movement of the magnetic particles through magnetic lines of flux of alternating polarity.

2. The magnetic separator as described in claim 1, in which said magnetic means comprise permanent magnets.

3. The magnetic separator as described in claim 1, in which said circular pattern of said magnetic means is concentric to the axis of relative rotation of said tray and said magnetic means.

4. The magnetic separator as described in claim 3, in which said magnetic means comprise a plurality of individual magnets each of which is of a rectangular configuration and is disposed with the major axis thereof in radially oriented position.

5. The magnetic separator as described in claim 4, in which one of the major edges of each of said magnets is coincident with a radius passing through the center of said circular pattern and said axis of relative rotation.

6. The magnetic separator as described in claim 1, wherein said magnetic means are permanent bar magnets of a rectangular configuration and are polarized along their minor axis.

7. The magnetic separator as described in claim 1, in which said magnetic means are symmetrically arranged in said circular pattern and comprise an even number of individual magnets of alternating polarity.

8. The magnetic separator as described in claim 1, in which one of said magnetic means is disposed non-symmetrically in said circular pattern to promote a disruption in the tumbling action of the magnetic particles at least once during each revolution of said tray relative to said magnetic means.

9. The magnetic separator as described in claim 1, in which said mounting means include a first annular bearing race on said tray and a second annular bearing race on said framework disposed concentric to the axis of rotation of said tray and antifriction elements interposed between said first and said second race members for positioning said tray in aligned adjacent relationship relative to said magnetic means.

10. The magnetic separator as described in claim 9, in which said first annular bearing race, said second annular bearing race and said antifriction elements define in combination a tapered roller bearing assembly.

11. The magnetic separator as described in claim 1, in which said mounting means include a magnetic coupling force between said magnetic means and the magnetic particles in said tray of a magnitude sufficient to retain said tray in appropriate mounted relationship on said framework.

12. The magnetic separator as described in claim 1, in which said means for moving said tray comprises inverting means on said framework for inverting said magnetic means and said tray as a unit in response to pivoting movement to and from said load position and said operating position.

13. The magnetic separator as described in claim 12, in which said inverting means comprises coacting means on said framework for pivotally mounting said magnetic means and said tray.

14. The magnetic separator as described in claim 1, in which said framework includes a support plate pivotally mounted on said framework and pivotable about a substantially horizontal axis to and from an upright position and an inverted position, said magnetic means and drive means mounted on said support plate and pivotable in unison therewith.

15. The method of separating non-magnetic particles from magnetic particles which comprises the steps of confining a quantity of a powder mixture of magnetic and non-magnetic particles in an annular cavity having walls of a substantially nonmagnetic material, orienting said cavity in a substantially horizontal plane, positioning said cavity beneath a circular pattern of magnetic fields of alternating north and south polarity and of a strength sufficient to cause the magnetic particles to be moved upwardly against the overlying wall of said cavity and in spaced relationship from the base of the cavity, relatively rotating said cavity and said magnetic fields about a generally upright axis to impart a tumbling action to elongated agglomerates formed of the magnetic particles and causing relative movement of the particles to effect exposure and release of non-magnetic particles entrapped therein, permitting the released non-magnetic particles to fall by the action of gravity to the base of the cavity, continuing the relative rotation of said cavity and said magnetic fields until substantially all of the non-magnetic particles have been separated and released from the magnetic particles, and separately recovering the magnetic particles and non-magnetic particles.

16. The method as defined in claim 15, including the further steps of measuring the quantity of powder mixture placed in said cavity and measuring the quantity of separated and recovered non-magnetic particles and calculating the percentage of contimination of the powder mixture with non-magnetic particles.

17. The method as defined in claim 15, including the further step of incorporating in the circular pattern of magnetic fields of alternating north and south polarity a discontinuity of the repetitive magnetic pattern in a manner to inhibit excessive growth of the elongated agglomerates and to effect a more uniform distribution of the magnetic particles radially across the width of the annular cavity.

* * * * *